US008308904B2

(12) United States Patent
Kukkamäki et al.

(10) Patent No.: US 8,308,904 B2
(45) Date of Patent: Nov. 13, 2012

(54) PRINTABLE PRODUCT AND A METHOD FOR MANUFACTURING A PRINTABLE PRODUCT

(75) Inventors: Esko Kukkamäki, Kangasala (FI); Kaisa Herranen, Pirkkala (FI); Markku Karlsson, Helsinki (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 12/991,718

(22) PCT Filed: Apr. 21, 2009

(86) PCT No.: PCT/FI2009/050302

§ 371 (c)(1),
(2), (4) Date: Dec. 10, 2010

(87) PCT Pub. No.: WO2009/135989

PCT Pub. Date: Nov. 12, 2009

(65) Prior Publication Data

US 2011/0088862 A1 Apr. 21, 2011

(30) Foreign Application Priority Data

May 9, 2008 (FI) ..... 20085435

(51) Int. Cl.
*D21H 11/00* (2006.01)

(52) U.S. Cl. ..... 162/177; 524/27

(58) Field of Classification Search ..... 162/177, 162/164.1, 164.3; 524/27; 525/55
See application file for complete search history.

(56) References Cited

U.S. PATENT DOCUMENTS

| | | | |
|---|---|---|---|
| 3,560,480 | A | 2/1971 | Kruger |
| 4,075,028 | A | 2/1978 | Amosov et al. |
| 6,048,938 | A | 4/2000 | Neal et al. |
| 6,090,871 | A | 7/2000 | Reiners et al. |
| 6,096,418 | A | 8/2000 | Sato et al. |
| 2002/0102661 | A1 | 8/2002 | Busink et al. |
| 2002/0185239 | A1 | 12/2002 | Kimpimaki et al. |
| 2004/0206464 | A1 | 10/2004 | Li |
| 2004/0226671 | A1 | 11/2004 | Nguyen |
| 2007/0107865 | A1 | 5/2007 | Tammi et al. |

FOREIGN PATENT DOCUMENTS

| | | | |
|---|---|---|---|
| DE | 199 57 348 | A1 | 5/2000 |
| EP | 0 924 342 | | 6/1999 |
| JP | 57-191083 | | 11/1982 |
| JP | 57 191083 | A | 11/1982 |
| JP | 2004-314395 | | 11/2004 |
| WO | WO 2007/065969 | | 6/2007 |
| WO | WO-2007/118264 | A | 10/2007 |

OTHER PUBLICATIONS

International Search Report, dated Nov. 18, 2009, issued in Counterpart International Application No. PCT/FI2009/050302.

Search report and statement on patentability issued by Finnish patent office in counterpart Finnish patent application 20085435, Feb. 27, 2009.

International Preliminary Report on Patentability, issued by the International Preliminary Examining Authority on Nov. 5, 2010, in connection with Counterpart International Application No. PCT/FI2009/050302.

*Primary Examiner* — Mark Halpern

(74) *Attorney, Agent, or Firm* — Venable LLP; Eric J. Franklin

(57) ABSTRACT

A printable product including a substrate including fibers. The substrate has a first side and a second side. At least one of the first side and the second side of the substrate includes a surface layer that does not substantially contain inorganic particles and forms an outermost surface layer of the substrate, which surface layer includes hemicellulose. A method for manufacturing a printable product and to a surface treating agent for treating a substrate including fibers.

13 Claims, No Drawings

PRINTABLE PRODUCT AND A METHOD FOR MANUFACTURING A PRINTABLE PRODUCT

CROSS-REFERENCE TO RELATED APPLICATIONS

This application claims priority to Finnish patent application 20085435 filed 9 May 2008 and is the national phase under 35 U.S.C. §371 of PCT/FI2009/050302 filed 21 Apr. 2009.

FIELD OF THE INVENTION

The present invention relates to a printable product. The invention also relates to a method for manufacturing a printable product. In addition, the invention relates to a surface treating agent.

BACKGROUND OF THE INVENTION

Attempts have been made to improve the properties of printable substrates, such as base papers of printing papers, by different surface treatments of the substrates. Surface treatments can improve the properties even so that cheaper raw material can be used in the base paper without affecting the properties of the paper. It is, for example, possible to replace chemical pulp with mechanical pulp or increase the filler proportions of the pulp. Surface treatments may be used to improve the properties of paper, such as gloss or surface resistance or printability of the paper. Printability properties include among other things density, gloss of the print and smoothness of the print.

Water solutions having effective substances, such as starch or polyvinyl alcohol, added to the solutions, are often used in surface treatments. Various techniques to produce surface treatments are known. These include treatments done with a surface-size press or spray coater. One alternative is to spray the surface treating agent onto the surface of the substrate. Normally it is advantageous if the desired effect can be attained with the smallest amount of substance. As the surface treating agent dries, it forms a surface layer onto the substrate.

Different base papers and different printing techniques can require different surface treatments. Common printing methods include offset and gravure printing techniques.

In offset printing a smooth-surfaced printing plate is used, which plate has hydrophobic areas which repel water and hydrophilic areas which repel printing ink. Printing plate is soaked with water, which then adheres to the hydrophilic areas. After that the brayed printing ink adheres to the hydrophobic areas. Printing ink and water are then transferred onto an elastic roll from which they are transferred onto the surface of the paper and the print forms onto the paper. Many variations are known in offset printing, such as heat set offset and cold set offset.

In gravure printing a printing plate is used, which plate has point-like recesses carved onto it for the printing ink. Printing ink can be brought into the recesses by dipping the roll in printing ink and scraping the excess ink off the surface of the roll. When bringing the ink onto the surface of the paper, an electric field can be used in order to lift the printing ink from the recesses.

One surface treatment used to improve the printability of the paper is disclosed in US publication 2007/0107865. A mixture formed from alkyl ketene dimer as well as the copolymer of styrene and anhydride of maleic acid is used as a surface treatment chemical. A surface treatment chemical is used in connection with i.a. SC papers. Surface treatment is especially suited for paper used in gravure printing.

Hemicellulose is a known natural polymer. It can be found from different plants, such as trees. The hemicellulose composition varies depending on the plant and even on the parts of plant, and usually more than just one type of hemicellulose is present in the plant. Hemicelluloses are water-soluble and they easily dissolve into the water, for example when the wood raw material is processed during the manufacturing of pulp. The exiting waste water from the paper or cellulose factories usually contains a substantial amount of hemicellulose which strains the waste water facility of the factory.

BRIEF SUMMARY OF THE INVENTION

The purpose of this invention is to provide a new type of printable product having such properties that the printing result is optimal. The purpose of this invention is also to provide a method for manufacturing a printable product. Furthermore, it is the purpose of this invention to provide a surface treating agent suited for the surface treatment of a printable product.

The invention is based on the idea that hemicellulose is used as a surface treating agent for a substrate that comprises fibres. The invention improves prior art in such a way that the substance usually straining the waste water can be utilized in order to improve the properties of a printable surface.

Another advantage of the invention is that by treating the printable substrate, such as the base paper of a printing paper, with the hemicellulose water solution, high gloss and high gloss smoothness as well as density (printing ink tone level) are achieved. Result is achieved with a water solution which comprises water and hemicellulose. The amount of hemicellulose in the final product can be really small, from 0.01 to 5 $g/m^2$/side of substrate, most preferably from 0.2 to 0.6 $g/m^2$/side of substrate calculated on dry substance. The advantage of the hemicellulose treatment is that brightness of the paper treated with hemicellulose does not substantially change. In addition, paper that is surface treated with hemicellulose does not dust much and the runnability with a paper machine as well as a finishing machine is good.

The surface treating agent according to the invention can be separated from the process and/or waste waters forming during the processing of raw wood material, for example in the paper or pulp factory processing wood or producing pulp. Wood material, such as wood chips, can be intentionally eluted with water in order to separate hemicellulose. Separated surface treating agent or hemicellulose is used to surface treat a substrate comprising fibres, for example a base paper of a printing paper. Thus, the product, method, surface treating agent and use of the surface treating agent according to the invention are all connected by an inventive idea which is based on the use of a material separating from wood raw material in order to improve the properties of the final product comprising fibres.

In this application the terms substrate, base paper, surface layer and surface treating agent layer are used. A substrate generally refers to the sheet or web-like substrate onto which surface a surface treating agent layer is formed. The substrate can be any substrate, such as paper or board, that contains at least partly fibres. Fibres are generally cellulose fibres. Fibres can be wood-based or they can originate from non-wood plants, such as straw. A base paper refers to a paper before a surface treating agent layer has been formed onto the surface of the paper. A surface treating agent layer is a layer comprising water which layer is formed onto at least one of the layers of the substrate. When the surface treating agent is dried or it dries by itself, it becomes the surface layer. The term paper refers also to board.

The hemicellulose used as a surface treating agent can be recovered from the process and/or waste water resulting from the manufacturing of mechanical pulp, in which case the hemicellulose in the water can be utilized and at the same time the strain caused to the waste water decreases. Thus, recovering the hemicellulose and utilizing it in the surface treating agent improves cost-effectiveness and environmental friendliness of a paper and/or pulp factory. In addition, recovering the hemicellulose from the process and/or waste waters is easy as well as simple and does not require substantial investments for equipment.

As already stated above, hemicellulose is present in trees and other plants. Usually 20 to 35% of dry weight of a tree is hemicellulose. Hemicelluloses are polysaccharides and they are water-soluble and amorphous. The hemicellulose compositions of different parts of trees and different types of wood differ from each other. The most important hemicellulose types are glucomannan, galactoglucomannan, arabinoglucoronoxylan, glucoronoxylan, arabinogalactane and xyloglucane. Glucoronoxylan is present in hardwood and arabinogalactane is present in larch. Galactoglucomannan and arabinoglucoronoxylan are present in softwood. Glucomannan is present in both softwood and hardwood but the glucomannan in hardwood and softwood differ from each other. Xyloglucane is present in the primary wall of a vegetable cell. Usually there are more than one hemicellulose present in different plants. Particularly interesting wood species are those in which mainly galactoglucomannan or arabinogalactane is present. Galactoglucomannan is obtained from, for example, softwood, such as spruce (*Picea Abies*). Arabinogalactane obtained from larch (*Larix Sibirica*) is also an interesting hemicellulose.

Hemicellulose can be recovered in connection with manufacturing of mechanical or chemical pulp or in a separate process, but it is usually advantageous to combine the recovering to the manufacturing of pulp. The recovery can take place by, for example, eluting raw wood material before the manufacturing of chemical pulp or the hemicellulose can be eluted i.a. from saw dust. The eluting can take place in alkaline or acidic conditions or enzymatically. It is possible to use raised temperatures during the eluting.

Another possibility is to recover hemicellulose from the process and/or waste waters of manufacturing mechanical pulp, such as groundwood or refiner groundwood. An example of such manufacturing of mechanical pulp is the manufacturing of thermomechanical pulp. Process and waste waters comprise the washing, dilution and circulation waters that are formed and used in the manufacturing process of mechanical pulp and paper. In connection with separating of hemicellulose, techniques that can be mentioned relating to the separating and/or drying of hemicellulose include for example spray drying, precipitation with alcohol, centrifugation, membrane filtering such as ultra filtering or nano filtering, or evaporation. In other words, an apparatus used to recover the hemicellulose can comprise, for example, a filtering unit, precipitation unit, centrifugation unit, evaporation unit or drying unit in order to separate the hemicellulose from the water. The above-mentioned units are needed also when the raw wood material is first eluted in order to separate the hemicellulose. Separating the hemicellulose from water can be performed using quite simple equipment and, in addition, the used technique can be chosen among many techniques intended for the purpose.

Hemicellulose can also be modified physically or chemically. Hemicellulose can be fractioned so that the desired molecular size is separated by filtering, for example with the help of a suitable membrane filtering technique. An example of chemical modification is the deacetylation of hemicelluloses which can be performed in connection with bleaching, such as peroxide bleaching, by raising the pH of the pulp. With this kind of chemical modification hemicellulose becomes less water-soluble and adheres well to the surface of pulp fibres.

The hemicellulose recovered from wood material with any of the methods presented above can be dried and stored, if desired, in a powdery form for a later use.

In forming a surface treating agent layer onto a surface of a substrate, such as a paper, a surface treating agent comprising hemicellulose is used. In forming the surface treating agent layer, a hemicellulose water solution is usually used. If the hemicellulose is dried after its separation, it is dissolved into water again before surface treatment.

As already stated above, the recovered hemicellulose from the process and/or waste waters resulted from manufacturing mechanical pulp can be dried and then dissolved again into water. Another possibility is that the recovered hemicellulose from the process and/or waste water is guided straight to the forming of the surface layer. Thus, the water fraction of the hemicellulose water solution contains at least partly process or waste water. Another possibility is to guide the process and/or waste water containing hemicellulose as such to form the surface layer. Especially the circulation water from a groundwood mill or refiner is suitable for recovering hemicellulose because of the hemicellulose content of the water. Furthermore, it is possible to concentrate the process and/or waste water containing hemicellulose so that the relative content of the hemicellulose increases, and the concentrated hemicellulose water solution is used to form the surface treating agent layer. Same uses apply to the hemicellulose separated by eluting the wood material as for the recovered hemicellulose from the process and/or waste water; the eluate can be first dried and then dissolved again into water, the eluate can be concentrated, or it can be guided straight to the forming of the surface layer.

Usually fibres are removed from the process and/or waste water before the hemicellulose is separated, but the hemicellulose water solution meant for forming the surface treating agent layer can contain fibres or material from the fibres and other possible impurities. The hemicellulose water solution substantially does not contain inorganic particles but inorganic material can also be among the impurities. In other words, the surface treating agent layer is pigment-free and the layer does not contain inorganic particles, such as kaolin, talc or calcium carbonate, known in context of coating of paper. Auxiliary agents needed in connection with the forming of the surface treating agent layer can also be in the hemicellulose water solution, for example auxiliary agents which control reology or which decrease or increase the formation of the layer.

The surface treating agent can comprise solely one type of hemicellulose. Generally it comprises a mixture of hemicelluloses from one wood species. It is possible to form the surface treating agent in such a way that it contains both the hemicellulose of a tree, for example galactoglucomannan and other hemicelluloses characteristic to the certain wood species as well as hemicelluloses originating from, for example, grasses. It is also possible to use hemicelluloses separated from different wood species, for example galactoglucomannan from soft/hardwood and xylan from birch, in the surface treating agent.

The surface layer can be formed onto the substrate, i.e. base paper or board, with the suitable technique and apparatus, for example with the suitable finishing method, such as a spray coater or surface-size press. In the spray coater the hemicellulose water solution is sprayed onto the substrate with a high-pressure spray, wherein the sprayable water solution is atomized to very small droplets which form the surface treating agent layer onto the surface of the paper. An unified film is formed from the hemicellulose water solution onto the surface of the substrate with the surface-sized press.

One possibility to form the surface treating agent layer onto the surface of the substrate is to use surface treating agent comprising hemicellulose as a moistening agent in the suitable step of manufacturing of paper web. The hemicellulose water solution can be sprayed onto the surface of the web and can be used as moistening solution for example in the moisturizers of the web. The hemicellulose water solution can be sprayed onto the paper for example with the drying section or calendering section, or the paper can be moistened with the hemicellulose water solution when reeling the paper web. Hemicellulose can be added to the moistening water of the calendar wherein a sufficient surface treating agent layer is formed onto the surface of the paper as well as a suitable moistening is attained for the calendaring at the same time. When the surface treating agent layer is formed by spraying, there is no need for a separate drying phase of the paper since the amount of water is usually small. In connection with the calendering heat is also used wherein the evaporation of water intensifies without requiring actual drying steps.

Yet another possibility to form the surface treating agent layer is to form the surface treating agent layer in the wet end of the paper machine, for example with a headbox. If the surface treating agent layer is formed with the headbox, the hemicellulose water solution is let onto the web as a separate flow in connection with a headbox discharge.

Usually the surface layer comprising hemicellulose is the only layer forming onto the surface of the substrate. It is still possible that there is some other layer or layers between the substrate and surface layer. The surface layer comprising hemicellulose can be on one or both sides of the substrate as the outermost layer.

Papers surface treated with hemicellulose are used as printing papers which can be printed with, for example, offset or gravure printing techniques. The paper surface treated with hemicellulose is particularly suitable for offset printing. An important application area is the supercalendered papers which are treated with hemicellulose wherein better printing properties are achieved. In other words, the printing properties of the paper treated with hemicellulose are close to the properties of LWC paper. Typically the composition of base paper treated with hemicellulose is 50 to 75 weight-% of mechanical pulp, 5 to 25 weight-% of chemical pulp and 10 to 35 weight-% of filler and grammage of printing paper is 40 to 60 g/m$^2$. The amount of hemicellulose calculated on dry substance can be from 0.01 to 5 g/m$^2$/side of paper, most preferably from 0.2 to 0.6 g/m$^2$/side of paper.

DESCRIPTION OF THE INVENTION USING AN EXAMPLE

Example

A surface treatment test was conducted using the hemicellulose water solution. A supercalendered paper was used as a base paper in the test. Samples were produced in the test wherein one sample was treated with hemicelluloses water solution (sample 1) and the other was a reference sample (sample 2). Hemicellulose was recovered from the clear filtrate of the refiner by ultra filtering and drying to powder. The main part of the hemicellulose was formed by galactoglucomannan from softwood. The surface treating agent was produced in such a way that the hemicellulose powder was mixed to a room temperature water. Surface treatment was made by spray coating.

The following testing methods were used to test the samples:

| | |
|---|---|
| Grammage | ISO 536: 1995 |
| Density | SCAN-P 7: 96 |
| Air permeability | SCAN-P 60: 87 |
| PPS roughness (PPS 10) | ISO 8791: −4 |
| Cobb water absorption | EN ISO 20535 |
| Gloss (Hunter) | ISO 8254-1: 1999 |
| IGT surface strength | SCAN P 63: 90 |
| K&N color absorption | SCAN P 70: 95 |
| Bending resistance | ISO 2493 |
| Bending stiffness | ISO 5629 |
| Gurley Hill air permeability | SCAN-P 19: 78 |
| ISO brightness | ISO 2470 |
| Opacity | ISO 2471 |

Testing of Printing:

Density was measured with a Macbeth surface reflectance meter from a fully opaque surface. The transparency and print through were measured with the surface reflectance meter at the same time. Both measurings were conducted 20 times/side. Breakdown is a calculated value which is derived from a formula breakdown=print through−transparency.

Printed gloss was measured with a L&W Code 224J gloss meter.

Missing points were measured using Dot program.

Mottling (smoothness of print) was measured using Pap-Eye Mottling program.

TABLE 1

Properties of a sample treated with hemicellulose and a reference sample.

| Description | Sample 1 | Sample 2 |
|---|---|---|
| Grammage, g/m$^2$ | 52.5 | 52.1 |
| Density, kg/m$^3$ | 1159 | 1133 |
| Air permeability, ml/min | 25.4 | 30 |
| PPS 10 yp/ap, μm | 1.12/1.29 | 1.16/1.29 |
| Cobb us/ls, g/m$^2$ | 4.5 | 5.4 |
| Gloss (Hunter), % | 45.9 | 44 |
| IGT surface strength us/ls, m/s | 0.82 | 0.64 |
| K&N us/ls, % | 66.66 | 66.1 |
| Bending stiffness 15° md/cd mN | 14.5/4.80 | 14.1/4.55 |
| Folding rigidity 5° md/cd, mNm | 0.052/0.020 | 0.048/0.017 |
| Gurleys Hill air permeability, s* | 469 | 378 |
| ISO brightness us/ls, % | 67.15 | 67.91 |
| Opacity, % | 92.01 | 92.34 |

*= Result measured from the L&W air permeability result.

Us = upper side, ls = lower side, md = machine direction, cd = cross-machine direction

TABLE 2

GRI gravure printing results of a sample treated with hemicellulose and a reference sample.

| Description | Sample 1 | | Sample 2 | |
|---|---|---|---|---|
| Density us/ls | 2.248 | 2.233 | 2.202 | 2.161 |
| Print through us/ls | 0.061 | 0.062 | 0.069 | 0.065 |
| Print through us/ls, % | 2.7 | 2.8 | 3.1 | 3.0 |
| Transparency us/ls | 0.032 | 0.032 | 0.035 | 0.033 |
| Breakdown us/ls | 0.028 | 0.03 | 0.034 | 0.032 |
| Printed gloss us/ls, % | 55.9 | 52.3 | 53.8 | 46.3 |
| Missing points us/ls, piece/cm2 | 5.9 | 9.7 | 6.4 | 8.8 |
| Mottling us/ls | 13.89 | 14.58 | 14.22 | 14.5 |

TABLE 3

HSWO (heat set web offset) printing results of a sample treated with hemicellulose and a reference sample.

| Description | Sample 1 | | Sample 2 | |
|---|---|---|---|---|
| Printing unit | upper side | lower side | upper side | lower side |
| Mottling index cyan 50% | 5.93 | 6.09 | 6.02 | 6.00 |
| Mottling index black 50% | 6.85 | 6.99 | 6.97 | 6.75 |
| Printed gloss black 100% | 56 | 55 | 34 | 34 |
| Printed gloss 3 color 300% | 57 | 52 | 45 | 40 |

From Tables 1, 2 and 3 can be seen an advantageous effect of the surface layer of hemicellulose on the properties of supercalendered paper. The surface layer formed by hemicellulose improves the printing result in connection with gravure printing and offset printing.

The invention claimed is:

1. A method for manufacturing a printable product, the product comprising a substrate containing fibers, the substrate comprising a first side and a second side, wherein at least one of the first side and the second side of the substrate comprises a surface treating agent layer comprising hemicellulose, the method comprising:

recovering the hemicellulose by at least one of from process water during manufacturing of mechanical or chemical pulp, from circulation water of a groundwood mill or a refiner pulp mill, from waste water of the mechanical or chemical pulp manufacturing, or by eluting wood material; and forming the surface treating agent layer by using a surface treating agent comprising the recovered hemicellulose on at least one of the first side and the second side of the substrate a surface treating agent layer, the surface treating agent layer being substantially pigment-free, and the surface treating agent layer forming a surface layer of the product.

2. The method according to claim 1, wherein the hemicellulose is recovered as a water solution, and wherein the surface treating agent includes the recovered hemicellulose water solution.

3. The method according to claim 1, further comprising:

forming the surface treating agent layer from the recovered hemicellulose water solution.

4. The method according to claim 3, further comprising:

concentrating the hemicellulose water solution before guiding the hemicellulose water solution as a water solution onto the surface of a substrate in order to form the surface layer.

5. The method according claim 3, further comprising:

drying the recovered hemicellulose; and using the dried hemicellulose in the preparation of the hemicellulose water solution.

6. The method according to claim 1, further comprising:

guiding the recovered hemicellulose water solution without any chemical treatment onto the surface of a substrate in order to form a surface layer.

7. The method according to claim 6, wherein the substrate comprises paper.

8. The method according to claim 1, wherein the surface treating agent layer is formed from a hemicellulose water solution comprising at least one hemicellulose selected from the following: glucomannan, galactoglucomannan, arabinoglucuronoxylan, glucuronoxylan, arabinogalactane and xyloglucane.

9. The method according to claim 1, wherein the surface treating agent layer is formed by spraying water solution containing hemicelluloses onto a substrate.

10. The method according to claim 9, wherein the water solution comprising hemicellulose is sprayed onto a substrate in connection with calendering.

11. The method according to claim 1, wherein the surface treating agent layer is formed by a coating method.

12. The method according to claim 11, wherein the surface treating agent layer is formed by using a spray coater or a surface-size press.

13. The method according to claim 1, wherein the surface treating agent layer is formed with the help of a headbox in the wet end of the paper machine in connection with the forming of the substrate.

* * * * *